US005666105A

United States Patent [19]

Adler et al.

[11] Patent Number: 5,666,105

[45] Date of Patent: Sep. 9, 1997

[54] PERSONAL RADIATION HAZARD METER

[76] Inventors: Zdenek Adler, 513 Woodfield Rd., West Hempstead, N.Y. 11552; Mitchell M. Tuckman, 29 Spinner La., Commack, N.Y. 11725

[21] Appl. No.: 612,306

[22] Filed: Mar. 7, 1996

Related U.S. Application Data

[63] Continuation-in-part of Ser. No. 109,837, Aug. 20, 1993, Pat. No. 5,576,696.

[51] Int. Cl.[6] ..... G08B 17/12

[52] U.S. Cl. ..... 340/600; 324/95; 250/336.1

[58] Field of Search ..... 340/600; 324/95 R, 324/106; 343/702, 841, 718; 250/336.1, 370.07, 338.1, 482.1

[56] References Cited

U.S. PATENT DOCUMENTS

| | | | |
|---|---|---|---|
| 3,927,375 | 12/1975 | Lanoe et al. | 340/600 |
| 3,931,573 | 1/1976 | Hopfer | 324/106 |
| 4,038,660 | 7/1977 | Connolly et al. | 343/18 A |
| 4,301,367 | 11/1981 | Hsu | 250/370 |
| 4,336,532 | 6/1982 | Biehl et al. | 340/600 |
| 4,489,315 | 12/1984 | Falk et al. | 340/600 |
| 4,518,912 | 5/1985 | Aslan | 324/95 |
| 4,851,686 | 7/1989 | Pearson | 340/600 |
| 5,036,311 | 7/1991 | Moran et al. | 340/600 |
| 5,168,265 | 12/1992 | Aslan | 340/600 |
| 5,373,285 | 12/1994 | Aslan | 340/600 |
| 5,512,823 | 4/1996 | Nepveu | 340/600 |
| 5,576,696 | 11/1996 | Adler | 340/600 |

OTHER PUBLICATIONS

Radar Cross Section—It's Prediction, Measurement and Reduction by Knott et al. pp. 1–2, 247–252, 269, Copyright 1985.

American National Standard Safety Levels With Respect to Human Exposure to Radio Frequency Electromagnetic Fields 300 kHz to 100 GHz by The Institute of Electrical & Electronics Engineers, Inc. ANSI C95.1–1982.

*Primary Examiner*—Jeffery Hofsass
*Assistant Examiner*—Daniel J. Wu
*Attorney, Agent, or Firm*—Volpe and Koenig, P.C.

[57] ABSTRACT

An electromagnetic radiation monitor for use in close proximity with the human body comprised of an electromagnetic radiation sensor for detecting hazardous radiation levels. The radiation monitor also includes means for shielding the sensor from electromagnetic interference caused by the human body. A single layer of a plurality of lossy materials arranged in a precise, predetermined mosaic pattern is used in conjunction with a shield to prevent interference due to unwanted reflections caused by the shield resulting in a wideband frequency response previously unachievable.

20 Claims, 9 Drawing Sheets

PERSONAL RADIATION HAZARD METER

This application is a continuation-in-part of U.S. patent Ser. No. 08/109,837, filed Aug. 20, 1993, now U.S. Pat. No. 5,576,696.

BACKGROUND OF THE INVENTION

1. Field of the Invention

This invention relates to electromagnetic radiation detection devices. More particularly, this invention relates to electromagnetic radiation detection devices which may be worn by an individual to alert such an individual of harmful levels of electromagnetic energy over a broadband of frequencies.

2. Description of Prior Art

The use of high power radio and microwave frequencies in the military, commercial and consumer applications has grown substantially. The applications of high power electromagnetic sources are numerous, including for example, radar, satellite communication ground terminals, radio transmitting antennas and microwave ovens.

One problem with high power electromagnetic radiation is its potential harmful effects on lining tissue. The American National Standards Institute have established safety guidelines to prevent exposure to harmful levels of electromagnetic radiation.

Harmful levels of electromagnetic radiation may not be detected by an individual until permanent damage results. Accordingly, a work place in the vicinity of high power electromagnetic sources can be a dangerous environment. Therefore, there is a need for a device which can sense and measure electromagnetic radiation and provide an alert signal indicating harmful ambient levels. Furthermore, because of the numerous applications of electromagnetic sources and the multitude of frequencies generated, such electromagnetic radiation detection devices having a broadband frequency performance are desirable.

Broadband electromagnetic radiation detection devices have been used in the art for many years. For example, U.S. Pat. No. 3,931,573 assigned to the assignee of the present invention, discloses a hand-held radiation detector. However, hand-held radiation detectors may sometimes be cumbersome and inconvenient. Therefore, radiation hazard meters which can be worn by an individual are both practical and desirable.

When constructing a personal radiation hazard meter, electromagnetic interference from a human body is a concern. It is known that interference in the form of electromagnetic scattering results when electromagnetic radiation reflects off the human body. Such scattered reflections interfere with the electromagnetic radiation being detected by the radiation detector and introduce inaccuracies.

To minimize body interference, the radiation sensors of personal radiation hazard meters require shielding of the electromagnetic radiation sensor from the user's body. The shield, however, may produce its own source of interference due to unwanted reflections.

The use of lossy material as a radiation absorber to absorb reflective radiation is well known in the art. However, lossy material has an acceptable reflective characteristic over a limited frequency range. Generally, the more highly absorbent the lossy material is the smaller the useful frequency range it has. The relatively large operational bandwidth of the monitor precludes the use of a single type of lossy material. This property of lossy material suggests that the use of multiple layers of lossy material having different absorption (and, accordingly, reflective) characteristics would be most effective in eliminating reflective interference from the conductive shield.

An example of this technique is shown in U.S. Pat. No. 5,168,265 (Aslan). A less absorbent/reflective lossy material is disposed behind the radiation sensor, then at least a second layer of more absorbent/reflective lossy material is disposed behind the first layer and in front of the shield. The lamination of lossy materials reduced body reflected radiation and lessened measurement errors over the operational bandwidth of the monitor.

Although layering lossy materials has been tried what is desired is a body worn microwave radiation monitor having a frequency response that is immune to body reflected interference.

SUMMARY AND OBJECTS OF THE INVENTION

A personal radiation monitor is provided having the back of its radiation sensors shielded to enable the meter to be worn on the human body without reflected body interference. A single layer of different lossy materials arranged in a mosaic is disposed between the shield and the sensor which effectively eliminates reflective interference from the shield.

The object of this invention is to provide an improved personal radiation hazard meter which has accurate broadband frequency performance characteristics.

It is another objective of this invention to provide an improved personal radiation hazard meter which minimizes the effects of electromagnetic radiation interference caused by a human body.

It is yet another object of this invention to provide an improved personal radiation hazard meter which displays the power density of the electromagnetic radiation being sensed and alarms the user whenever the radiation exceeds a user programmed level.

It is another object of this invention to provide an improved personal radiation hazard meter which may be used with an earphone to allow the user to work in high noise environments.

Other objects and advantages of the personal radiation monitor will become apparent to those skilled in the art after reading the detailed description of the preferred embodiment.

DESCRIPTION OF THE PREFERRED EMBODIMENT

Figure 1:
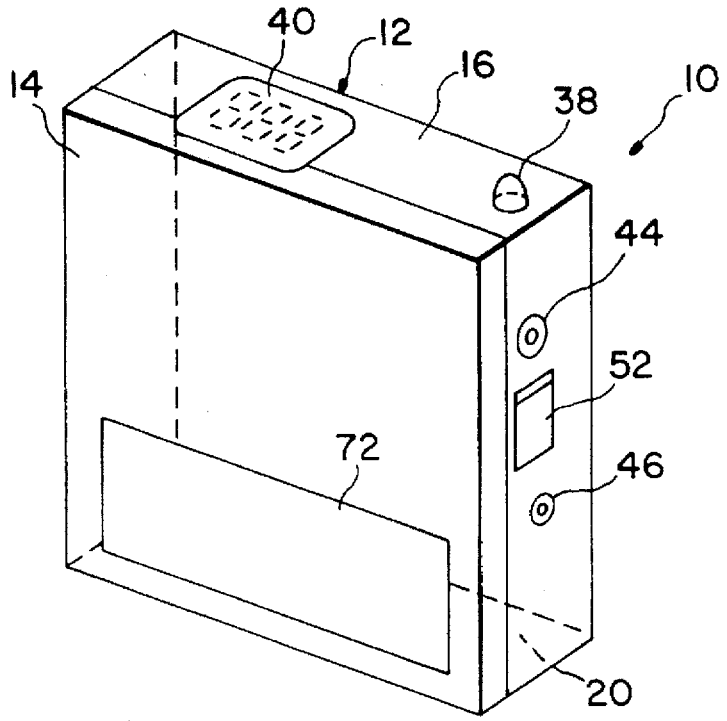
FIG. 1 is a front perspective view of a personal radiation hazard meter made in accordance with the present invention.
Figure 2:
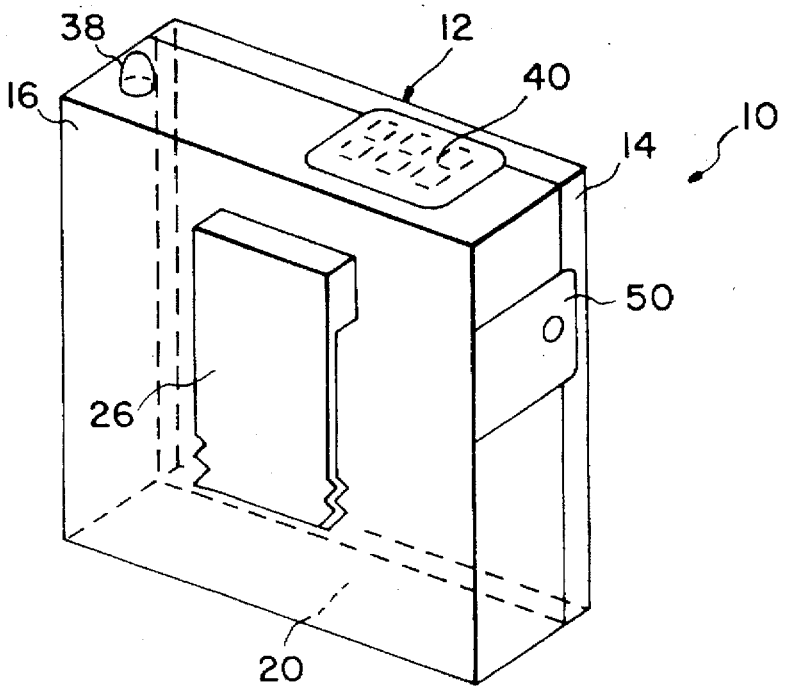
FIG. 2 is a back perspective view of the radiation hazard meter shown in FIG. 1.
Figure 3:
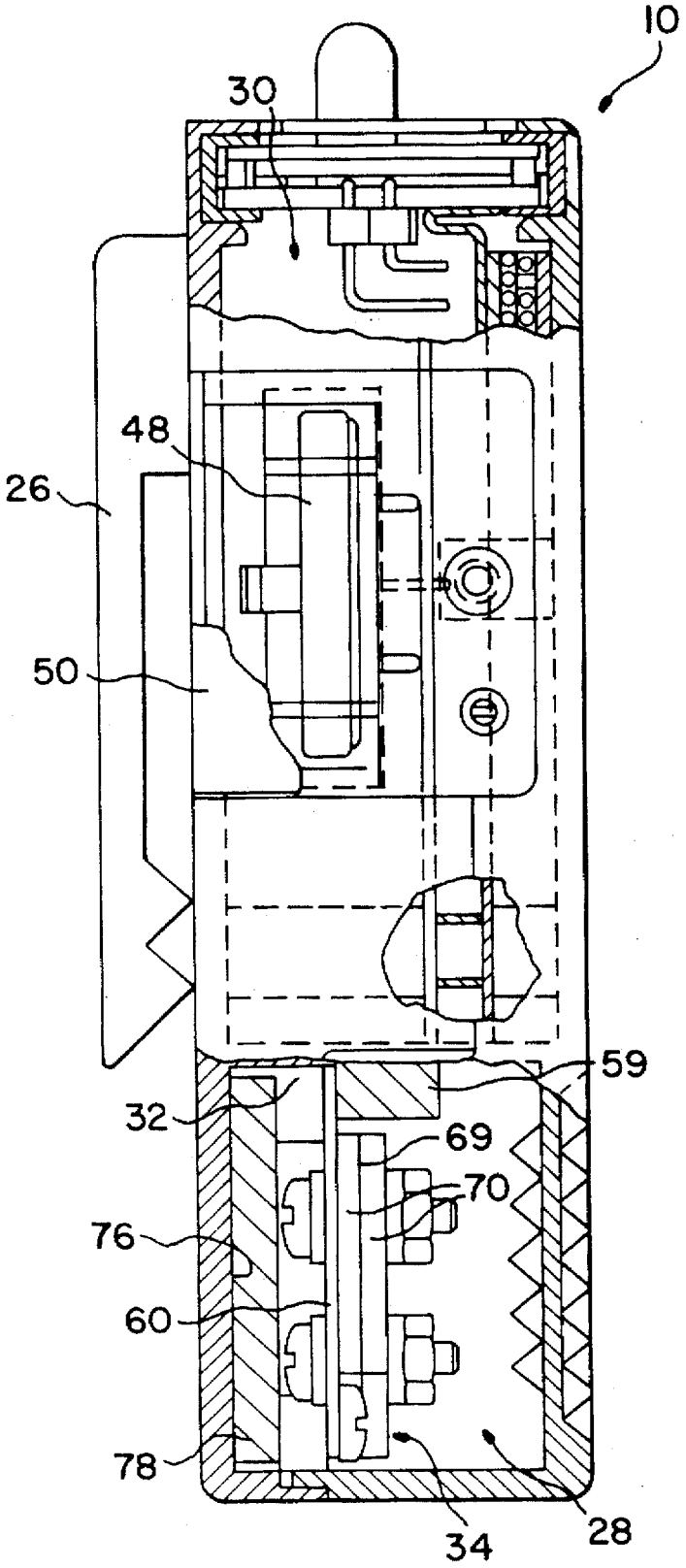
FIG. 3 is a left side cross-sectional view of the radiation hazard meter shown in FIG. 1.

The preferred embodiment will be described with reference to the drawing figures where like numerals represent like elements throughout.

With reference to FIGS. 1–5, there is shown a radiation hazard meter 10 which is to be used in close proximity to a human body. The meter 10 has a two-piece housing 12 comprised of a front cover 14 and a containment 16. The back of the monitor includes a clip 26, so that the monitor can be clipped to a user's belt or clothing. The interior of the housing 12 is partitioned into lower and upper chambers 28, 30 by an interior wall 32. The lower chamber 28 houses an antenna assembly 34 which functions as the radiation sensor. The upper chamber 30 houses the electronic processing circuitry 36 which is electrically coupled to sensor 34. The electronic processing circuitry 36 analyzes the radiation levels detected by the antenna assembly 34. For example, see U.S. Pat. No. 3,931,573, and the references cited therein which patents are incorporated herein by reference as if fully set forth.

The electronic processing circuitry 36 is operatively associated with a light emitting diode (LED) 38, an alphanumeric liquid-crystal display (LCD) 40, and a speaker 42 associated with an earphone receptacle 44. The LED 38 continuously flashes to alarm the user when the radiation sensor 34 detects electromagnetic radiation which exceeds a user programmable pre-determined level. The radiation hazard meter 10 also warns the user with speaker 42 producing an audible alert signal either alone or through the earphone receptacle 44 to the user via an earphone 45. In addition, the alphanumeric LCD display 40 also flashes when the radiation hazard meter 10 alarms.

In the preferred embodiment, the electronic processing circuitry 36 is configured to permit audioranging and multiple modes of measurement indication. The radiation hazard meter 10 autoranges from 0.02 to 20.0 mW/cm$^2$ and has a user programmable alarm level setting between the ranges of 0.01 to 20.0 mW/cm$^2$. A measurement indication switch 46 enables the user to change the instantaneous power density indicated on the LCD display 40 from milliwatts per centimeter squared or the six minute average power density in milliwatts per centimeters squared, depending on the switch setting.

The electronic processing circuitry 36 is powered by one or more lithium batteries 48 which are installed into the upper compartment via a battery hatch 50. An on/off switch 52 controls the power supplied from the batteries 48 to the electronics 36.

To prevent undue interference with the performance of the electronic processing circuitry 36, shielding is provided. In particular, a combination of layered absorbent material and metallic shield are disposed in front of and below the electronic processing circuitry 36. The circuitry shielding is comprised of a first layer of a relatively low absorbent lossy material 54, a layer of relatively high absorbent lossy material 56 and a thin layer of foil or conductive paint 58 behind the relatively high absorbent lossy material 56. The relatively low absorbent layer of lossy material 54 is Eccosorb® LS-16, manufactured by Emerson and Cuming, Inc. The relatively high absorbent layer of lossy material 56 is Eccosorb® FGM-40, also manufactured by Emerson and Cuming. The properties of the lossy materials are set forth in Emerson and Cuming's Technical Bulletins 8-2-23 dated January, 1985 and 2-11 dated November, 1980 which are herein incorporated by reference as if fully set forth.

Figure 4:
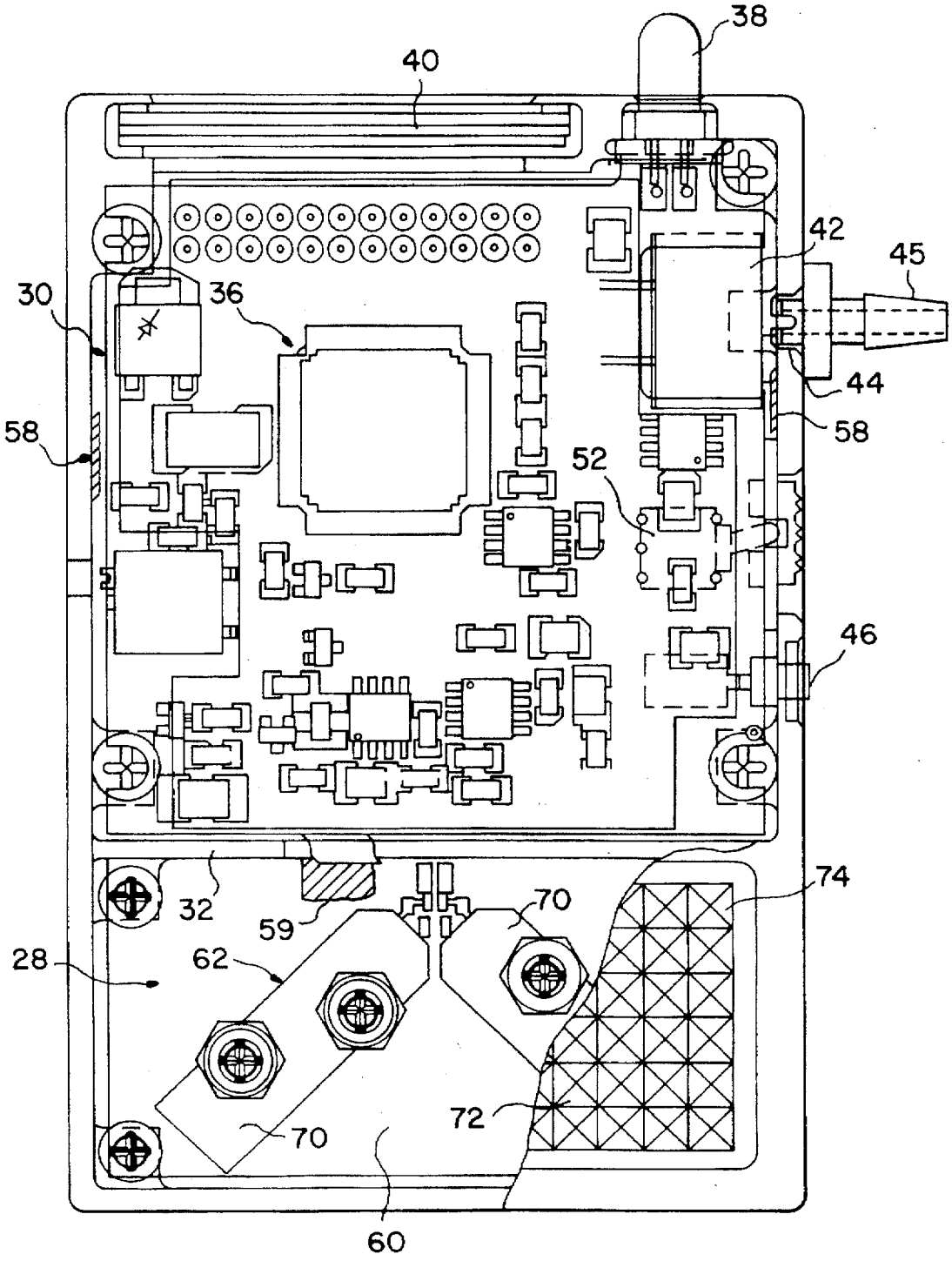
FIG. 4 is a front open-cover view of the radiation hazard meter shown in FIG. 1.
Figure 5:
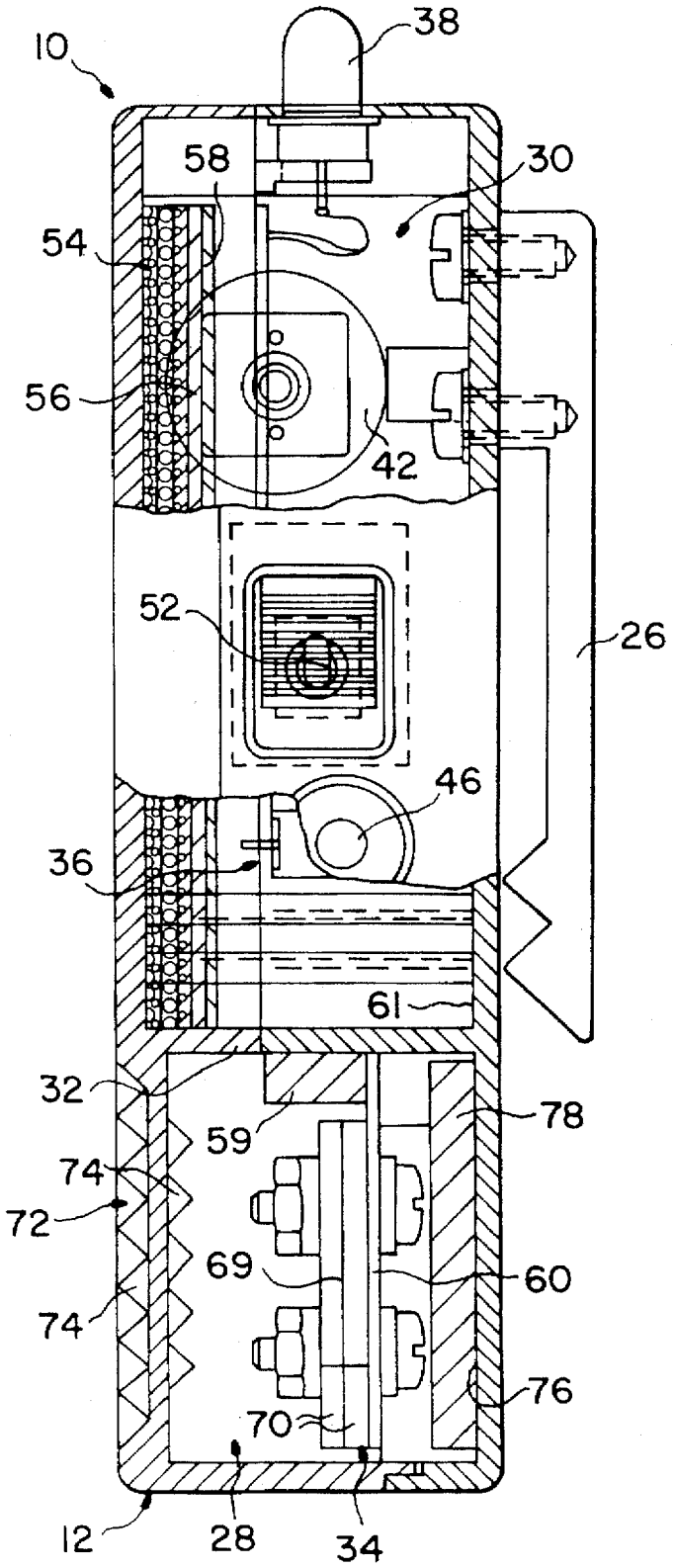
FIG. 5 is a right side cross-sectional view of the radiation hazard meter shown in FIG. 1.

Additional shielding in the form of conductive paint or foil 58 is provided for the sides, partially shown for clarity in FIG. 4, of the electronic processing circuitry 36. Further protection is provided below the electronic processing circuitry 36 by absorber 59 mounted on the upper wall of the lower chamber 28. Absorber 59 is a uniform layer of lossy material such as Eccosorb® FGM-40 or LS-26 manufactured by Emerson and Cuming. The interior of the upper portion of the containment 16 is provided with a coating of metallic paint 61 which provides shielding in back of the processing circuitry 33.

Figure 6:
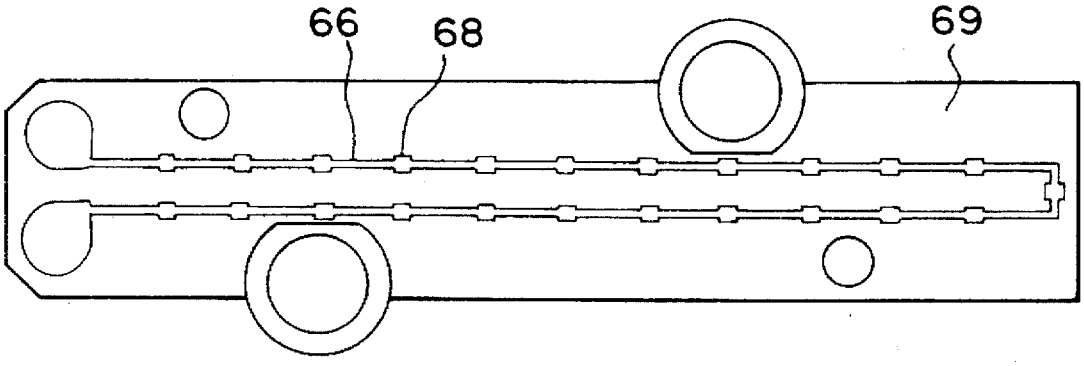
FIG. 6 is a front elevation view of an antenna element of the radiation hazard meter shown in FIG. 1.

The radiation sensor assembly 34 comprises a dielectric panel 60. Mounted on the front of the dielectric panel 60 are two mutually orthogonal sensor assemblies 62 which are coplanar with each other. As shown in FIG. 6, each sensor assembly 62 includes an array of thin film thermocouples 66, 68 formed on a substrate 69. Each thermocouple is composed of two dissimilar metals such as bismuth 66 and antimony 68 and are connected in series as set forth in U.S. Pat. No. 3,931,573.

Each thermocouple supporting substrate 69 is sandwiched between a pair of dielectric covers 70 which are mounted on the panel 60. The dielectric covers 70 are made of boron nitride chosen for the properties of high thermal stability and high electrical resistance. The sensor assembly 34 absorbs and converts a portion of the impinging radiation into heat. The heat is then converted thermoelectrically into a dc voltage for processing, measurement and display.

A radiation window 72 is defined in the front of the sensor chamber 28 in the housing. The window 72 is defined by a square array of pyramidal shapes 74 molded on both sides of the housing cover 14. At high frequencies, this construction tends to have a scattering effect on any reflected signal to inhibit reflections back onto the antenna, covering a wide range of incident angles.

Since the radiation monitor is designed to be worn on a person's body, shielding is desirable behind the radiation sensor assembly 34 to prevent interference attributable to the user's body. Such shielding is provided in the form of a layer of conductive paint and/or foil 76 disposed on the back wall of the sensor chamber 28. No shielding is provided on the bottom or sides of the sensor chamber 28 since the effect of body interference from those angles is negligible.

Although the metallic shielding 76 serves to shield the sensor assembly from reflected interference from the rear, it similarly causes radiation measured from the front to be reflected back towards the sensor assembly 34. Such reflected radiation affects the frequency response of the sensor resulting in measurement inaccuracies across the operational bandwidth.

Figure 7:
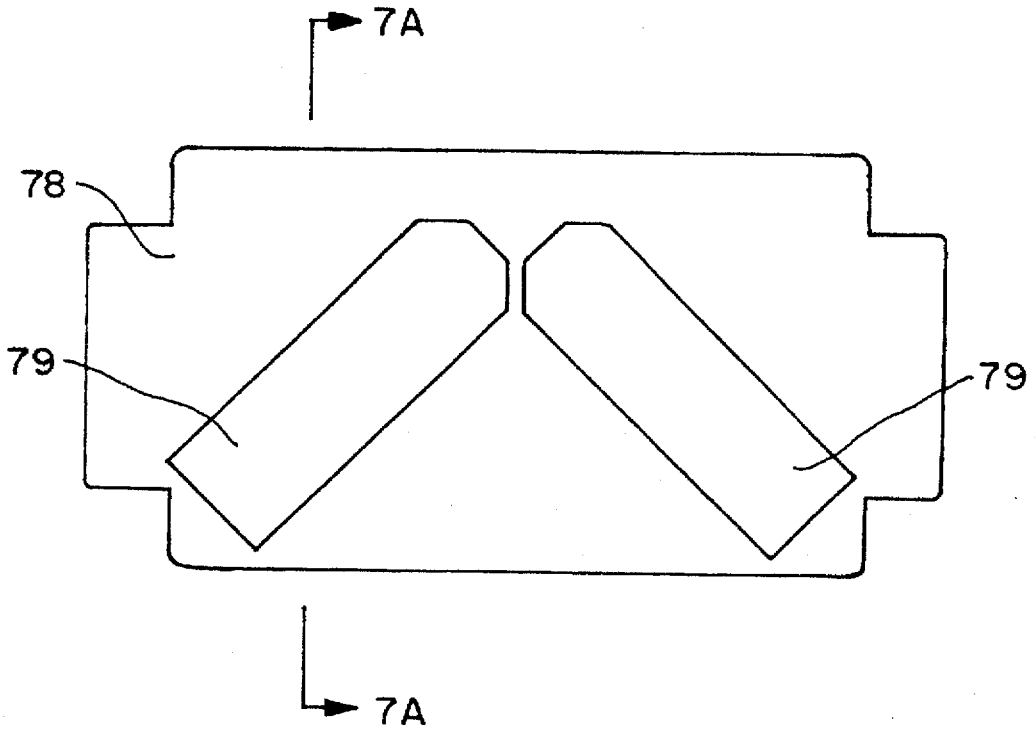
FIG. 7 is a plan view of the single layer of lossy material of the radiation hazard meter shown in FIG. 4.

As shown in FIG. 7, in the preferred embodiment, a single layer mosaic of two uniform lossy materials, Eccosorb® FGM-40 78 and Eccosorb® MF-190 79 both 3.2 mm thick, are mounted directly on the metallic shielding 76. The thermocouple sensors 66 and 68 are disposed approximately 5.7 mm in front of the front surface of the layer of lossy material 78 of which approximately 3.2 mm is an air gap between the mounting panel 60 and the lossy material 78.

Figures 7A, 7B, 7C:
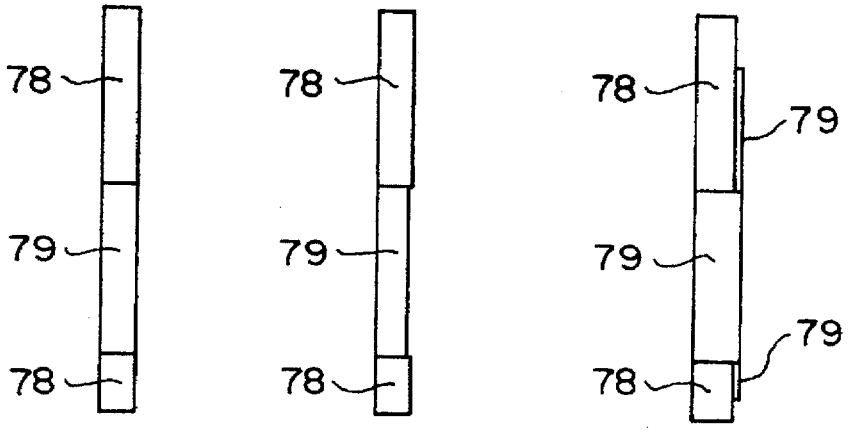
FIG. 7A is a cross-sectional view of the lossy materials shown in FIG. 7.
FIG. 7B is a cross-sectional view of an alternative embodiment of the lossy materials shown in FIG. 7.
FIG. 7C is a cross-sectional view of another alternative embodiment of the lossy materials shown in FIG. 7.

Two variations of the preferred embodiment vary the height of the lossy material 79 directly under each radiation sensor 62 as shown in FIGS. 7B and 7C. FIG. 7B shows the thickness of the low absorbent lossy material 79 less than the thickness of the high absorbent lossy material 78. FIG. 7C shows the thickness of the low absorbent lossy material 79 greater than the high absorbent lossy material 78. Varying the thickness of the low absorbent lossy material acts to tune and flatten the frequency response of the radiation sensor 62 assembly.

Figure 8:
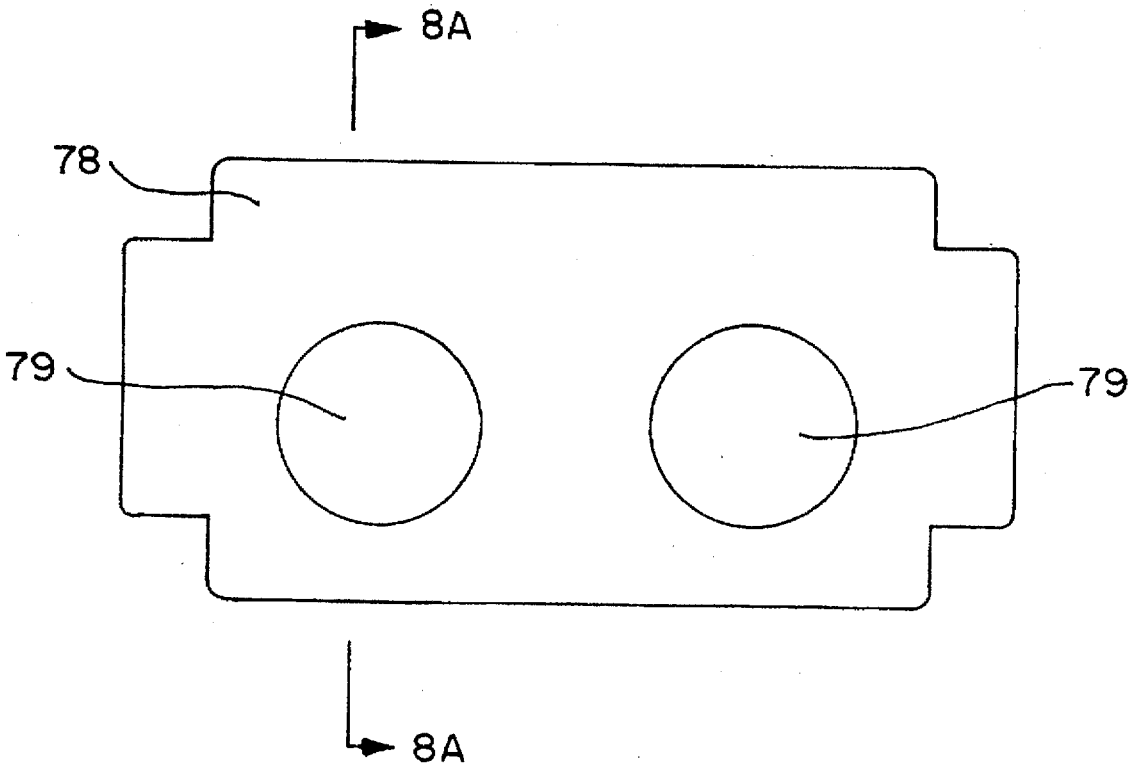
FIG. 8 is a plan view an alternative embodiment of the single layer of lossy materials of the radiation hazard meter shown in FIG. 4.
Figures 8A, 8B, 8C:
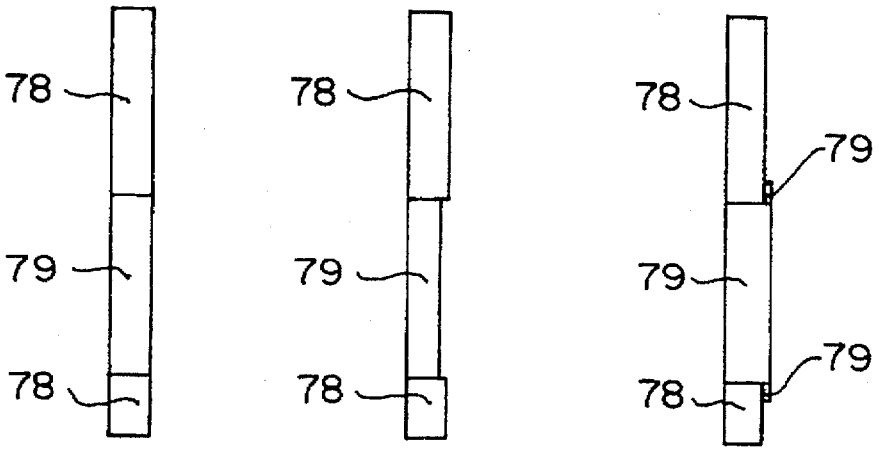
FIG. 8A is a cross-sectional view of the lossy materials shown in FIG. 8.
FIG. 8B is a cross-sectional view of an alternative embodiment of the lossy materials shown in FIG. 8.
FIG. 8C is a cross-sectional view of another alternative embodiment of the lossy materials shown in FIG. 8.

An alternative embodiment of the uniform lossy material mosaic is shown in FIG. 8. The low absorbent lossy material 79 is circular rather than a silhouette of each radiation sensor 62 assembly. As shown in FIG. 8A, both types of lossy material are the same thickness as previously discussed. As shown in FIGS. 8B and 8C, the low absorbent lossy material is varied in thickness to similarly tune the frequency response of the radiation sensors 62.

Figure 9:
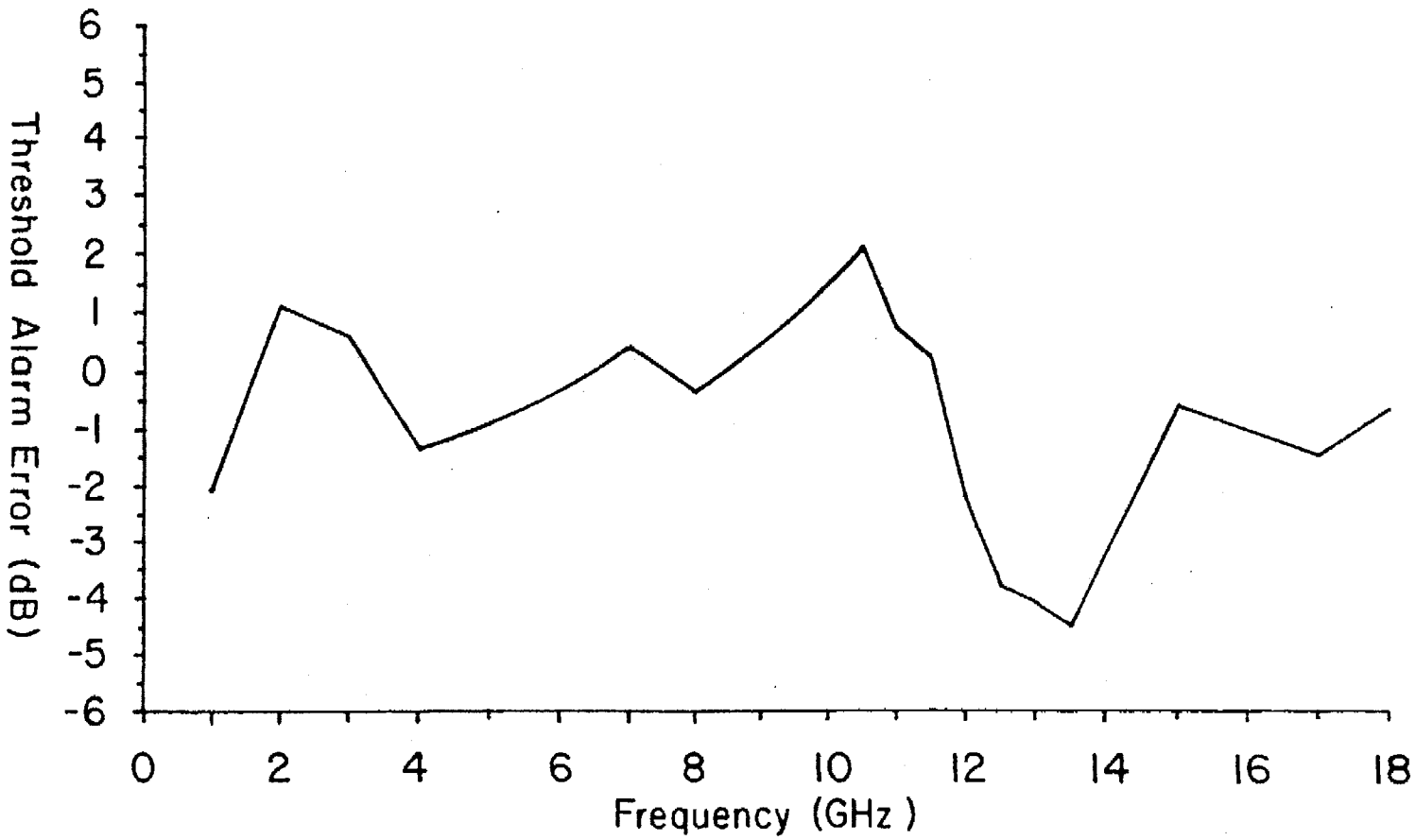
FIG. 9 is a graph showing the frequency response of a typical radiation hazard meter.

FIG. 9 illustrates the frequency response of the initial attempt utilizing a single layer of lossy material in the radiation hazard monitor 10. As seen from the graph, minimum and maximum responses varied about 6.5 dB across a frequency band of 1 GHz to 18 Ghz.

Figure 10:
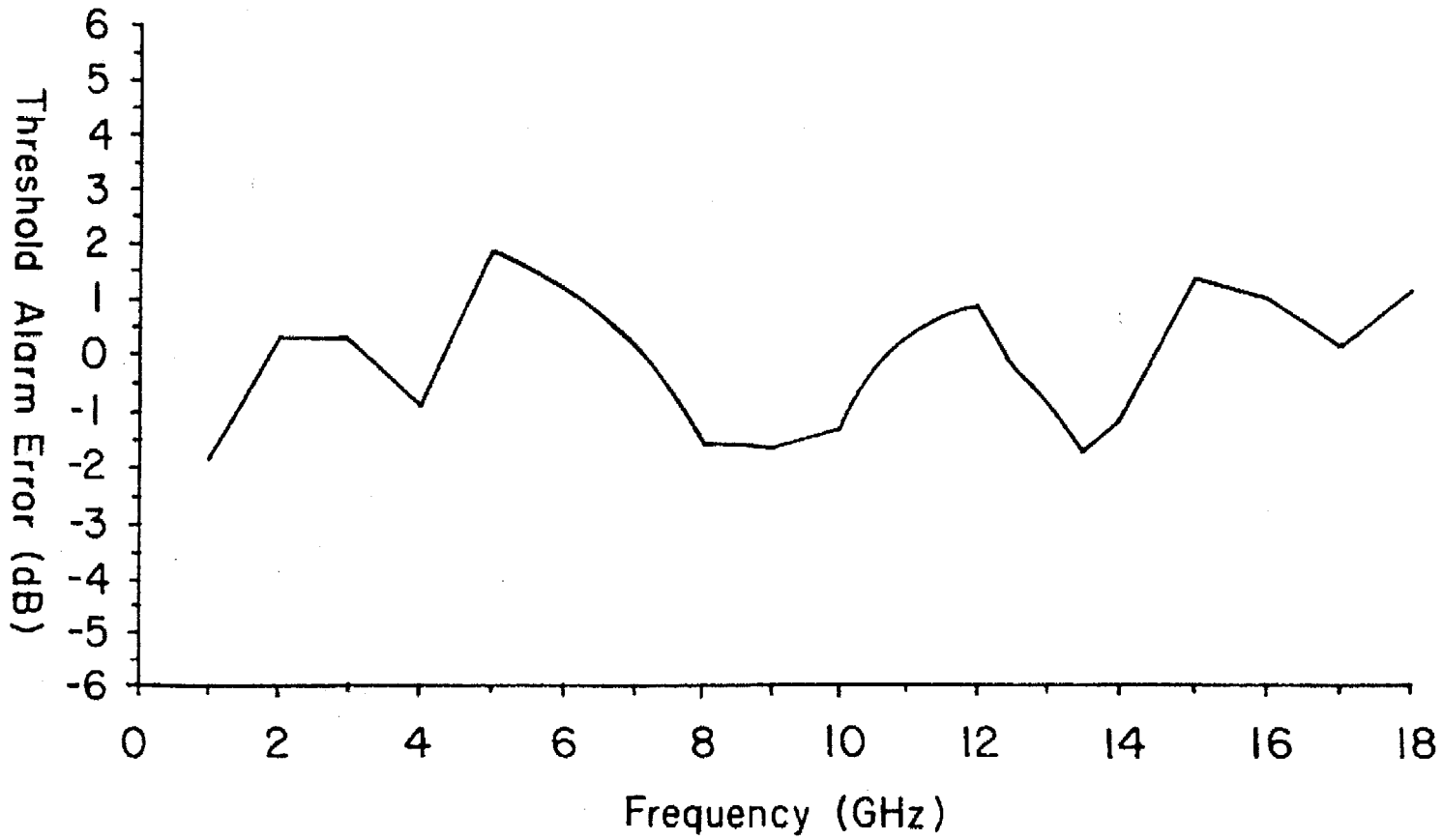
FIG. 10 is a graph showing the frequency response of the radiation hazard meter shown in FIG. 1.

In comparison, FIG. 10 shows the frequency response of the preferred embodiment. As seen from the graph, the radiation hazard meter 10 exhibits a relatively flat frequency response with less than 4.0 dB variation across a bandwidth of 1 GHz to 18 GHz. This is an improvement of 3.0 dB as compared to a single uniform layer comprised of only one lossy material.

In operation, the radiation sensor 34 absorbs a portion of the electromagnetic radiation which enters the sensing chamber 28 and generates a dc voltage that is proportional to the energy of the electromagnetic radiation. The electromagnetic radiation that travels past the radiation sensor 34 propagates through and is partially absorbed by the lossy material 78 and converted to heat. Any radiation which is not absorbed by the lossy material 78 reflects off the shield 76. The reflected electromagnetic radiation travels in the reverse direction through the lossy material 78 towards the radiation sensor 34. The round-trip propagation through the lossy material 78 substantially reduces or eliminates the energy of the reflected electromagnetic radiation. Although some of the radiation reflects directly off the front of the lossy material 78, the result is the virtual elimination of electromagnetic radiation scattering.

Although the invention has been described in part by making detailed reference to certain specific embodiments, such details are intended to be instructive rather than restrictive. It will be appreciated by those skilled in the art that many variations may be made in the structure and mode of operation without departing from the spirit and scope of the invention as disclosed in the teachings herein.

What is claimed is:

1. An electromagnetic radiation monitor for use in close proximity with a human body comprising:

an electromagnetic radiation sensor means having front and back sides;

shield means mounted in back of the radiation sensor means a selected distance such that when the radiation monitor is used in close proximity with a human body, the shield means defines a radiation barrier between the human body and the entire back side of the sensor means; and means for preventing reflective interference from said shield means with said sensor means including a mosaic layer of at least two different areas of lossy materials having different radiation absorbency characteristics.

2. The electromagnetic radiation monitor according to claim 1, wherein said electromagnetic radiation sensor means comprises a plurality of orthogonal and coplanar arrays of thin film thermocouples.

3. The electromagnetic radiation monitor according to claim 2, wherein said arrays of thin-film thermocouples are formed on a dielectric substrate.

4. The electromagnetic radiation monitor according to claim 3, wherein said thermocouples and dielectric substrate are sandwiched between covers of boron nitride.

5. The electromagnetic radiation monitor according to claim 1, wherein said shield means comprises a portion of a back wall of a monitor housing which is coated with a conductive paint.

6. The electromagnetic radiation monitor according to claim 1, wherein said means for preventing reflective interference is mounted a preselected spaced distance behind said sensor means and in front of said shield means wherein a single layer of lossy materials includes at least two different lossy materials having different radiation absorbency characteristics arranged in a predetermined mosaic pattern.

7. The electromagnetic radiation monitor according to claim 1, which further includes an electronic circuit electrically coupled to said radiation sensor for generating a user programmed alarm signal in response to ambient radiation detected by said sensor.

8. The electromagnetic radiation monitor according to claim 6, wherein said predetermined mosaic pattern consists of a first uniform lossy material exhibiting a first radiation absorbency which completely surrounds at least one selectively shaped area of a second uniform lossy material which exhibits a second different radiation absorbency characteristic.

9. The electromagnetic radiation monitor according to claim 8, wherein said first and second uniform lossy materials have the same thickness within said layer.

10. The electromagnetic radiation monitor according to claim 8, wherein said second uniform lossy material thickness is less than said first uniform lossy material thickness within said layer.

11. The electromagnetic radiation monitor according to claim 8, wherein said second uniform lossy material thickness is greater than said first uniform lossy material thickness within said layer.

12. The electromagnetic radiation monitor according to claim 8, wherein said second uniform lossy material is disposed directly behind said radiation sensor means and is configured as tiles representing the silhouette of said radiation sensor means.

13. The electromagnetic radiation monitor according to claim 8, wherein said second uniform lossy material is disposed directly behind said radiation sensor means and is configured as circular tiles.

14. An electromagnetic radiation monitor comprising:

an electromagnetic radiation sensor;

a conductive shield associated with said sensor; and a means for preventing reflective interference from said shield with said sensor consisting essentially of a single layer of uniform lossy materials arranged in a predetermined mosaic pattern interposed between the sensor and the shield, said single layer of uniform lossy materials having a front face and a back face, the back face attached to the shield, the front face selectively spaced apart from the sensor.

15. The electromagnetic radiation monitor according to claim 14, wherein said electromagnetic radiation sensor comprises a plurality of orthogonal and coplanar arrays of thin film thermocouples.

16. The electromagnetic radiation monitor according to claim 14, wherein said predetermined mosaic pattern consists of a first uniform lossy material exhibiting high radiation absorbency which completely surrounds at least one selectively shaped area of a second uniform lossy material exhibiting low radiation absorbency.

17. The electromagnetic radiation monitor according to claim 16, wherein said first and second uniform lossy materials have the same thickness within said layer.

18. The electromagnetic radiation monitor according to claim 16, wherein said second uniform lossy material thickness is less than said first uniform lossy material thickness.

19. The electromagnetic radiation monitor according to claim 16, wherein said second uniform lossy material thickness is greater than said first uniform lossy material thickness.

20. The electromagnetic radiation monitor according to claim 16, wherein said second uniform lossy material is disposed directly behind said radiation sensor means and is configured as tiles representing the silhouette of said radiation sensor means.

* * * * *